US005569031A

United States Patent [19]

Heed

[11] Patent Number: 5,569,031

[45] Date of Patent: Oct. 29, 1996

[54] COMBUSTION DEVICE

[76] Inventor: Bjorn Heed, Utlandagatan 19, S-412 61 Göteborg, Sweden

[21] Appl. No.: 244,135

[22] PCT Filed: Aug. 24, 1992

[86] PCT No.: PCT/SE92/00575

§ 371 Date: May 17, 1994

§ 102(e) Date: May 17, 1994

[87] PCT Pub. No.: WO93/12380

PCT Pub. Date: Jun. 24, 1995

[30] Foreign Application Priority Data

Dec. 9, 1991 [SE] Sweden ..... 9103634

[51] Int. Cl.[6] ..... F23G 7/06

[52] U.S. Cl. ..... 431/170; 431/7; 431/5; 431/215; 422/175; 422/177; 422/206; 422/211; 165/4

[58] Field of Search ..... 431/215, 7, 5, 431/170; 422/175–176, 177–206–211; 165/4, 909, 9.1, 9.4

[56] References Cited

U.S. PATENT DOCUMENTS

| | | | |
|---|---|---|---|
| 2,078,948 | 5/1937 | Houdry | 422/211 X |
| 2,078,950 | 5/1937 | Houdry | 422/211 X |
| 2,421,744 | 6/1947 | Daniels et al. | 431/170 X |
| 2,642,338 | 6/1953 | Pike | 422/206 X |
| 4,741,690 | 5/1988 | Heed | 431/7 |
| 5,024,817 | 6/1991 | Mattison | 431/7 X |
| 5,422,077 | 6/1995 | Bayer | 431/7 X |

FOREIGN PATENT DOCUMENTS 0127746 12/1984 European Pat. Off. .

*Primary Examiner*—Carl D. Price
*Attorney, Agent, or Firm*—Dvorak and Traub

[57] ABSTRACT

A combustion device (1) incorporated in an apparatus for combustion and/or decomposition of pollutants in air or other gases. The device has a stationary bed of e.g. sand having heat-accumulating and heat-exchanging properties. The bed is provided with heating means to heat a central part of the bed to the self-decomposition and/or the self-combustion temperature of the medium to be treated. The stationary bed (2) is placed on an essentially horizontal support (3), and at the remaining sides it is enclosed by side elements (4, 5) and a roof element (6), the latter resting directly on the upper face of the bed (2) so that the bed supports the roof element (6) and the loads to which the latter is exposed. Inside the bed upper, essentially horizontal tubes (7) are arranged as well as lower, essentially horizontal tubes (8), all said tubes being provided with valve systems at their ends. In this manner a stream of air or gas may be directed from one (8) of the perforated tubes, through the bed (2) and into the other (7) perforated tube in accordance with a first mode of operation. Combustion or decomposition of the pollutants is effected inside the bed. In accordance with a second mode of operation, the direction of flow through the bed may be reversed.

8 Claims, 2 Drawing Sheets

COMBUSTION DEVICE

TECHNICAL FIELD OF THE INVENTION

The subject invention concerns a combustion device incorporated in an apparatus for combustion and/or decomposition of pollutants in gaseous form, in the form of droplets or other particles that are carried by the air or other gases. The combustion device has a stationary bed of sand, rock or other materials having heat-accumulating and heat-exchanging properties, and means for heating a central part of said bed to the self-decomposition and/or the self-combustion temperature of the medium to be treated. The combustion device is of the type known as regenerative and is arranged to receive flows of said pollutants alternately from different directions.

BACKGROUND OF THE INVENTION

In order to decompose pollutants through combustion in a device known as a combustion exchanger (see U.S. Pat. No. 4,741,690), a structure having one upper and one lower air distributing duct is often used. The polluted air passes through the layer of bed material positioned between said ducts, and the bed material often consists of sand which has been pre-heated to an elevated temperature of about 1000° C.

The capacity expressed as quantity of air flow per time unit is determined by the parameters pressure drop and temperature of the bed. The pressure drop is a function of the thickness of the bed, the composition of the material of the bed, the surface structure, the granular size and the compaction degree of the material of the bed, and so on. To obtain a satisfactory degree of purification, expressed as the proportion of pollutants remaining in the exhaust in relation to the amount of pollutants in the incoming gas, a certain dwelling time in the hot zone is required. Each bed layer therefore provides a specific degree of purification for a given flow capacity, depending on the composition and thickness of the bed material. When the velocity of the air passing through the bed is high, the pressure drop becomes considerable. The area of the bed in a combustion exchanger therefore determines the dimensions of the total flow.

Because of the restrictions laid down by the road traffic rules and regulations concerning transports, units manufactured in one place for installation elsewhere, must not exceed certain limits as to their area and as a result they have a restricted flow capacity.

If the combustion exchanging technology is to be used to treat flows larger than those for which the largest units allowable on public roads are intended, larger units, built in situ, may be used as an alternative to prefabricated units. This alternative provides economical advantages as the costs per flow unit become smaller.

Large flows require large bed areas. In one combustion exchanger of conventional construction the polluted air is distributed across a horizontal bed area through an air gap above and below the bed area.

In large-size plants, this construction embodying an air gap would necessitate large spans in the structure forming the roof of the sealed air gap.

Large spans in roofs that are exposed to positive or negative pressures necessitate complicated and thus expensive structures. In addition, the air gap underneath the bed also is a complication in large installations from a maintenance point of view.

PURPOSE OF THE INVENTION

The purpose of the invention is to considerably reduce the above problems by providing a combustion exchanger designed in such a manner that the air gap above and underneath the bed becomes superfluous. As a result, the bed material may be deposited directly on a hard support and the roof structure may be supported by the bed material on the upper face thereof.

SUMMARY OF THE INVENTION

The above purpose is achieved in a combustion device in accordance with the invention, possessing the characteristics set forth in the appended claims.

The combustion device in accordance with the invention thus is essentially characterized in that the air to and from the bed is distributed in the bed material by means of horizontal, perforated tubes which extend for instance in parallel with the shortest dimension of the bed. The tubes may be positioned in pairs, one upper and one lower. A valve mechanism positioned at either end of each tube determines the direction of flow inside the tube. By opening or closing selected valves, the air flow may be made to flow from the lower to the upper tube in a first operative phase and in the reverse direction in a second operative phase. Usually, the tubes have round cross-sectional shape but other suitable cross sections are possible. The polluted air thus flows in an essentially vertical direction between the tubes and it is heated in the bed layer in such a manner that combustion and/or decomposition of pollutants take place and the air thus is purified.

The bed is pre-heated by means of a healer. The principles of cleaning and heating appear from U.S. Pat. No. 4,741,690. The roof, which should be sealed air-tight from the exterior, may rest on the bed material except at the edges, where sealing is required. By installing a suction fan on the inlet side of the combustion device a negative pressure is created in the plant, with the result that on the one hand the roof and the side walls will bulge inwards so as to rest on the bed, and on the other that the sealing effect at the edges of the roof will be improved. In other words, the bed supports the roof and the loads to which it is exposed, which is a definite advantage, since the installation costs may be reduced considerably. On account of the weight of the bed material a pressure is created inside the bed. The horizontal tubes must be able to resist this pressure. Normally, they have a circular cross-sectional shape, which is a section well capable of resisting bulging inwards. This means that tubes having a comparatively small wall thickness may be used both for air supply and air evacuation purposes in the bed. This is an economical solution.

It is also possible to use other cross-sectional configurations than the circular one for the tubes, provided the latter are dimensioned accordingly. Furthermore, a blower fan may be used on the inlet side, provided that the dimensions of the roof and the side walls are adapted accordingly. By means of partition walls directed in parallell with the tubes the installation may be divided into sections. These can be individually connected and disconnected from the system independently of one another, which facilitates servicing and also increases the possibilities to adapt the capacity to the actual flows. Additionally, the bed material in one section may be replaced without affecting the rest of the installation.

The valve system may be such that each tube is provided at one of its ends with a valve means comprising a sealing body having a cross-sectional configuration corresponding to the internal cross-sectional configuration of the associated tube, said sealing body being arranged for movement in the axial direction of the tube. In an outer position, the sealing body interrupts the communication between the tube and the associated inlet or outlet while in its inner position it does not significantly disturb the communication.

In accordance with a further development of the invention modular units of the combustion device are arranged in superposed relationship. They may be separated by horizontal divisioning means delimiting separate sections. They could also be designed so as to make the divisioning means superfluous. In this case, simultaneous supply of polluted gas and simultaneous evacuation of purified gas, respectively, are effected in the upper horizontal tubes in one modular unit and in the lower horizontal tubes in the modular unit above. Said tubes may then also be united into one common tube. In either case, the result is a double section. In similar ways two or more "double modular units" may be positioned in superposed relationship and may have tubes in common. By "section" should be understood in this context a unit which is delimited by partition wall whereas as a modular unit has no partition wall.

BRIEF DESCRIPTION OF THE DRAWINGS

The invention will be described in closer detail in the following with reference to some embodiments thereof and to the accompanying drawings wherein the same reference numerals have been used in all drawing figures to indicate corresponding components and wherein.

DETAILED DESCRIPTION OF PREFERRED EMBODIMENTS

Figure 1:
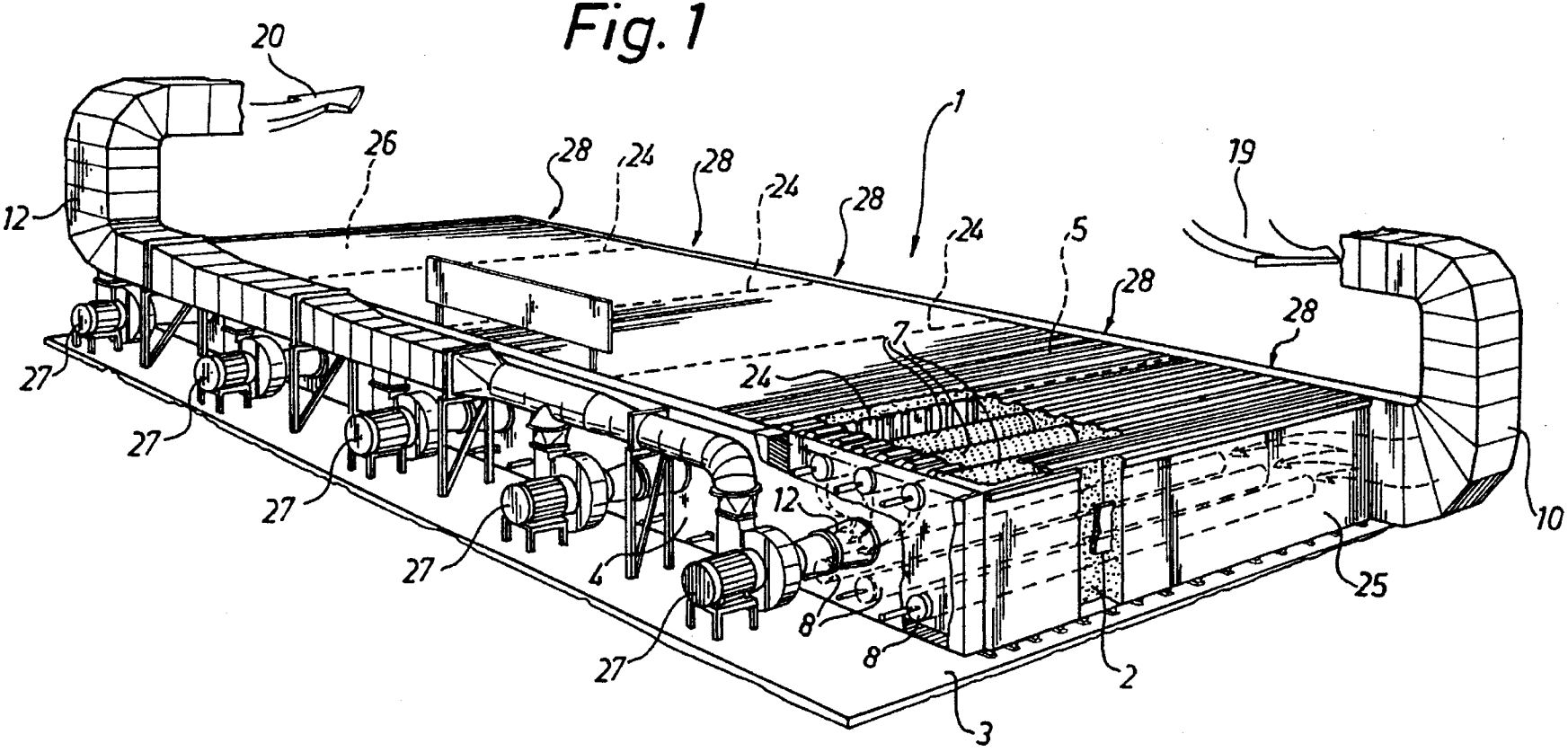
FIG. 1 is a perspective view of a combustion device for purification of gases.

In FIG. 1 reference numeral 1 is used to designate a combustion device for purification of air or other gases. On a floor 3 is supported a stationary bed 2 of sand, rock or other material having heat accumulating and heat-exchanging properties. The bed is enclosed by side elements 4, 5, a roof element 6, and end elements 25, 26. The roof element 6 rests in direct contact with the upper face of the bed 2 in such a manner that the bed supports the roof element 6 as well as the loads to which the latter is exposed.

A number of tubes 7, 8 extend across the bed 2. The tubes are all arranged in parallel and spaced-apart relationship. Usually, their cross-section shape is circular but also other cross-sectional configurations are possible. The tubes are arranged in one upper row 7 of tubes and one lower row 8. The polluted air 19 is admitted into the combustion device 1 through one of several inlets 10. Purified air 20 is evacuated from the combustion device 1 via one or several outlets 12.

As a rule, a number of fans 27 are connected to the outlet part to ensure that the air is sucked through the combustion device 1. Mostly it is an advantage if a negative pressure is created in the combustion device so that the walls of the device will bulge inwards, into contact with the bed 2, to be supported thereby. However, it is likewise possible to position a number of fans on the inlet side to create a positive pressure in the combustion device in this case the enclosure means 3, 4, 5, 25 and 26 must be reinforced in some other way to withstand the positive pressure inside the combustion device.

FIG. 1 also show vertical partition walls 24 delimiting various sections 28 of the combustion device. As a result of this arrangement, the bed material, for instance, could be replaced in one section of the combustion device while simultaneously the rest of the sections are in operation. In accordance with the embodiment illustrated, each section comprises three pairs of upper and lower tubes 7, 8 and is served by one fan 27. The combustion devices comprises a total of five sections.

Figure 2:
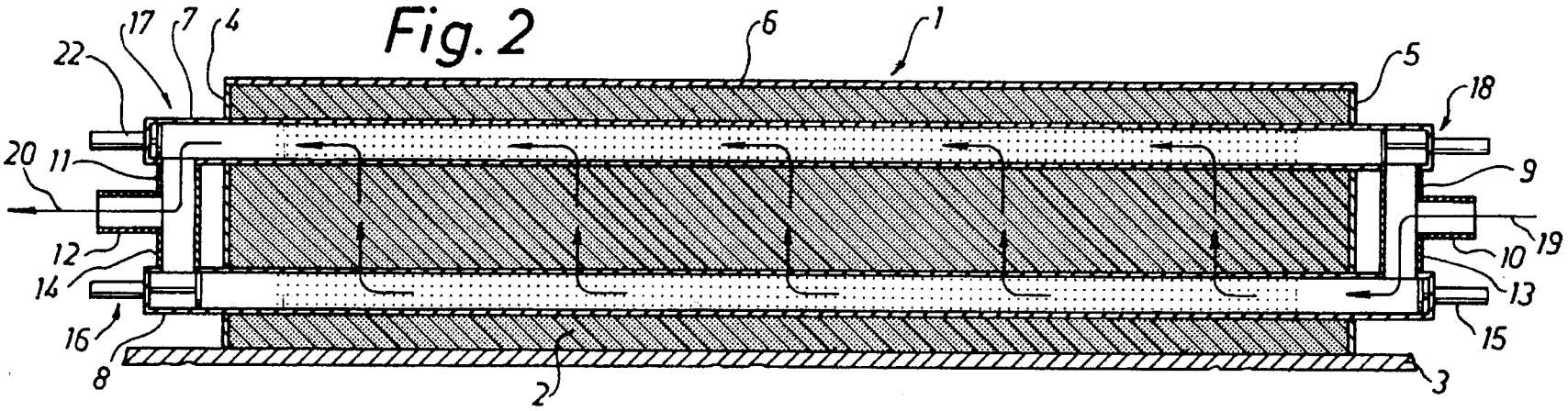
FIG. 2 is a schematic cross-sectional view of a part of a combustion device corresponding to the device in FIG. 1 in its first mode of operation.
Figure 3:
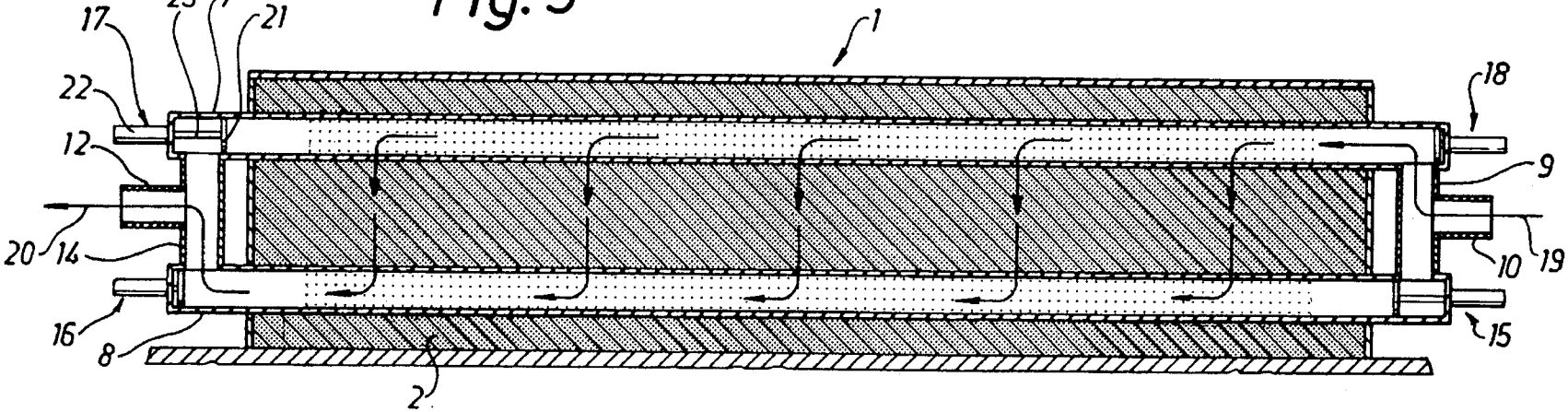
FIG. 3 is a cross-sectional view corresponding to that of FIG. 2 but with the device in a second mode of operation.

FIGS. 2 and 3 illustrate the structure and function of the combustion device in closer detail. These drawing figures are cross-sectional views taken vertically through an upper tube 7, a lower tube 8 and the inlet 10 and the outlet 12 associated with these tubes. The two horizontal tubes 7 and 8 are perforated, i.e. a large number of holes are pierced through them, the size of which depends on the particular bed material that is used. At the tube ends valve means 15–18 are provided. By means of connective pieces the ends of the tubes are coupled to the inlet and the outlet. For instance, an upper inlet connection 9 connects the upper tube 7 to the inlet 10 and an upper outlet connection 11 connects the tube to the outlet 12. A lower inlet connection 13 connects the lower tube 8 to the inlet and a lower outlet connection 14 connects it to the outlet 12. The connections could be designed in various ways. For instance, the upper inlet connections 9 and the lower inlet connections 13 could consist of a pipe having a circular or other cross-sectional configuration. The pipe is connected to the horizontal tubes 7, 8 and to the inlet 10. The connective pieces could also have box shape. The "box" thus formed is connected to several horizontal tubes and to one or several inlets or outlets. The horizontal tubes 7, 8 usually have a circular cross-sectional shape but also other cross-sectional configurations are possible. The connection pieces could be different at the two ends of the combustion device. Since the outlet side normally is coupled to a suction fan, it is exposed to a stronger negative pressure and consequently it might need to be of sturdier construction.

According to the valve system 15–18 one valve means is inserted at each end of each tube. A sealing body 21 the section of which corresponds to the internal cross-section of the tubes 7, 8, is arranged to move in the axial direction of the tube between an outer position, in which the body blocks the communication between the tube and the corresponding inlet or outlet, and an inner position, in which it does not significantly interfere with the communication. The sealing body 21 is attached to a piston rod 23 of a cylinder 22, the latter being mounted and operative in the axial direction of the tube. The cylinder is operated by pressurized air or by hydraulic means. The valve system 15–18 could also be such that the sealing body 21 seals axially against the end of the horizontal tube 7, 8, for example when the inlet or outlet is box-shaped. In this case, the cylinder is attached to the box.

FIG. 2 illustrates the function of the combustion device 1 in accordance with the first mode of operation and FIG. 3 the function according to the second mode of operation. At change-overs from one mode to the other, the direction of flow of the air in the stationary bed 2 is reversed.

In accordance with the first mode of operation illustrated in FIG. 2, the lower inlet connection 13 is open, allowing polluted air 19 to flow from the inlet 10 through the inlet connection 13 down into the lower horizontal tube 8. Holes dimensioned as a function of the material of the bed 2 perforate the lower tube 8. The valve positioned at the remote end 16 of the tube is closed. The polluted air thus will flow into the bed, through The perforations in The tube 8. The bed, which often consists of sand, is heated to an elevated temperature. The temperature is sufficiently high to cause self-destruction and/or ignition of the pollutants in the air at this temperature. This means temperature levels of about 1000° C., normally, a level at which polluted air from car paint spraying booths is to be purified. In order for the bed 2 to reach this elevated temperature before the polluted air is supplied to the combustion device, a heater, positioned inside the bed, is used for heating. The heater may be an electric heater or may be heated by gas, oil or some other suitable fuel. The pollutants may be in the form of gas, droplets or other air-borne or gas-borne particles. As they are combusted or decomposed, heat is generated, generally, and this heat is supplied to the bad material. Owing to this heating of the bed, the hot zone thereof will move slowly in the direction of flow through the bed. When the hot zone begins to reach the upper horizontal tube 7, it is time to change over to the other mode of operation. Normally, each mode of operation lasts one or a few minutes, depending on the size of the installation, the pollutants, the material in the bed, and so on.

Upon change-over to the mode of operation 2, the valves 15–18 are re-set to the positions appearing from FIG. 3. As a result, the polluted air 19 will flow from the inlet 10 and the upper inlet connection 9 into the upper horizontal tube 7 and pass through the holes therein and into the stationary bed 2, wherein the air is purified and enters into the lower tube 8, from which it exits through the outlet 12 by way of the lower outlet connection 14.

One consequence of the change of the mode of operation is that some air present in the stationary bed 2 but not yet completely purified will be entrained in the clean air to the outlet. This insufficiently purified air will be dealt with by an external filter, such as a carbon filter. This method, like the heater device in the stationary bed, are described in detail in Applicant's previous patent U.S. Pat. No. 4,741,690. When the direction of flow is reversed, the hot zone will now travel from the area adjacent the horizontal tube 7 towards the area adjacent the lower horizontal tube 8. When this has happened, there is again a change-over to mode of operation 1, as illustrated in FIG. 2, and the sequence is repeated.

When there is a change of mode of operation all valves 15–18 thus are displaced more or less simultaneously in the upper tube 7 and the lower tube 8. On the other hand, change-overs in neighbouring pairs of tubes 7, 8 or in juxtaposed sections of the combustion device 1 could be arranged to take place with a certain delay in order to avoid pressure peaks which might arise, should a change-over take place in all pairs of tubes simultaneously.

The embodiment illustrated in the drawings is a typical example of the invention. But also other arrangements and designs of the sections of the combustion device or of the horizontal tubes are possible. For example, the sections which in accordance with FIG. 1 are separated by partition walls 24, may be stacked one on top of the other, instead of being position side by side. Such an arrangement may be suitable for instance if the available space is very limited. In this case horizontal partition walls between the sections or the modular units need not necessarily be used. If two modular units are positioned one on top of the other and without horizontal partition walls, and assuming that the two neighbouring tubes in the two modular units, i.e. the uppermost ones in one unit and the lowermost ones in the other, are respectively supplied simultaneously with polluted air and connected simultaneously to the outlet, the arrangement will operate well without partition walls. The two neighbouring tubes then may be assembled into one larger tube. This embodiment reduces the costs while at the same time it allows the sand bed to be utilized more efficiently. The bed therefore could have a reduced volume compared with the varieties described earlier. In the "double section" thus formed, an upper row of tubes, for instance three, and a lower row of tubes, for instance three, therefore will sandwich between them a central row of larger tubes, for instance three. The upper row and the lower row are supplied with polluted air simultaneously or are connected to the outlet simultaneously. A number of such double sections or double modular units may be placed in superposed positions. They may have a horizontal partition wall that extends between them but this is not necessary, since the upper and lower tubes of each double section or double modular unit are supplied with polluted air or are evacuated simultaneously.

I claim:

1. A regenerative bed incinerator apparatus for decomposing combustible contaminants in a process gas stream, comprising:

a heated stationary bed in the form of a regenerative bed of sand, stone, or other material having heat-accumulating and heat-exchanging properties, said bed having an upper face, a lower face, and a central portion;

a housing structure for enclosing said stationary bed comprised of a horizontal support for positioning said bottom face of said stationary bed thereupon, a pair of side elements, a pair of end elements, and a roof element interconnecting with said horizontal support, said side elements, and said end elements, said roof element in resting contact against said top face of said stationary bed such that said housing structure is free of an air gap between said structure and said stationary bed;

means for heating said central portion of said bed to a temperature that combusts or decomposes said process gas contaminants;

means for communicating said process gas stream into and out of said regenerative bed, said means comprising an upper perforated tube having an inlet and an outlet side, and a lower perforated tube having an inlet and an outlet side, and an inlet and outlet valving and piping means on each respective inlet and outlet tubing side, each of said tubes disposed in a vertical and parallel alignment to each other wherein each of said tubes transverses said central portion of said bed and extends beyond said enclosure through said side elements by a like extent, each of said tube extensions defining a respective tube end, said inlet side of said upper and lower tubes having tube ends in communication with each other through said inlet valving and piping means, wherein said inlet piping means is comprised of a vertically disposed inlet header pipe having a central inlet for introducing said gas stream into said apparatus, an upper inlet pipe connection above said inlet for connecting said inlet to said upper tube end, and a lower inlet pipe connection below said inlet for connecting said inlet to said lower tube end, said outlet side of said upper and lower tubes having tube ends in communication with each other through said outlet valving and piping means, wherein said outlet piping means is comprised of a vertically disposed outlet header pipe having a central outlet for removing said process gas stream from said apparatus, an upper outlet pipe connection above said outlet for connecting said outlet to said upper tube end, and a lower outlet pipe connection for connecting said outlet to said lower tube end, said inlet valving means comprised of an upper and a lower valve respectively received within an inlet side upper and lower tube end, and operable in an axial direction between an inner, open position and an outer, closed position, each of said valves having a valve body corresponding to an internal cross-section of said respective tube, each of said upper and lower valves respectively capable of preventing said communication between said upper tube and said inlet and said lower tube and said inlet, when said respective valve is in said closed position, said outlet valving means comprised of an upper and a lower valve respectively received within an outlet side upper and lower tube end, and operable in an axial direction between an inner, open position and an outer, closed position, each of said valves having a valve body corresponding to an internal cross-section of said respective tube, each of said upper and lower valves respectively capable of preventing communication between said upper tube and said outlet and said lower tube and said outlet when said respective valve is in said closed position, wherein in a first mode of operation, said upper inlet valve is in said closed position and said lower inlet valve is in said open position, while said upper outlet valve is in said open position and said lower outlet valve is in said closed position, said process gas stream entering said lower tube and forced to exit said tube through said perforations therein, said process gas steam upwardly percolating through said stationary bed and forced into said perforations in said upper tube, wherein said gas stream exits said upper tube and said apparatus through said outlet as a contaminant-free gas stream, and wherein in a second mode of operation, said upper inlet valve is in said open position and said lower inlet valve is in said closed position, while said upper outlet valve is in said closed position and said lower outlet valve is in said open position, said process gas stream entering said upper tube and forced to exit said tube through said perforations therein, said process gas stream downwardly percolating through said stationary bed and forced into said perforations in said lower tube, wherein said gas stream exits said lower tube and said apparatus through said outlet as a contaminant-free gas stream.

2. The apparatus of claim 1, wherein a change in the mode of operation from said first mode to said second mode is made through a re-setting of the valves such that there is a delay in the various pairs of valves in the first mode to that of the second mode in order to attenuate pressure peaks during said change.

3. The apparatus as claimed in claim 1, wherein each valve means further comprises a valve actuator which is actuated by a pressure medium, said valve body being attached to a piston rod of said actuator in a manner that the actuator displaces said valve body in the axial direction of the tube.

4. A regenerative bed incinerator apparatus for decomposing combustible contaminants in a process gas stream, comprising:

a heated stationary bed in the form of a regenerative bed of sand, stone, or other material having heat-accumulating and heat-exchanging properties, said bed having an upper face, a lower face, and a central portion;

a housing structure for enclosing said stationary bed comprised of a horizontal support for positioning said bottom face of said stationary bed thereupon, a pair of side elements, a pair of end elements, and a roof element interconnecting with said horizontal support, said side elements, and said end elements, said roof element in resting contact against said top face of said stationary bed such that said housing structure is free of an air gap between said structure and said stationary bed;

means for heating said central portion of said bed to a temperature that combusts or decomposes said process gas contaminants;

means for communicating said process gas stream into and out of said regenerative bed, said means comprising a plurality of upper perforated tubes each having an inlet and an outlet side, and a like plurality of lower perforated tubes each having an inlet and an outlet side, and an inlet and outlet valving and piping means on each respective inlet and outlet tubing side, said plurality of upper and lower perforated tubes arrayed between said end elements of said housing structure such that at least one pair of like upper and lower tubes is separated from remaining tubes in said plurality, said separation affected by a partition wall extending between said structure roof and said horizontal support in a fashion parallel to said tubes, each of said like upper and lower tubes disposed in a vertical and parallel alignment to each other wherein each of said like upper and lower tubes transverses said central portion of said bed and extends beyond said enclosure through said side elements by a like extent, each of said tube extensions defining a respective tube end, said inlet side of said upper and lower tubes having tube ends in communication with each other through said inlet valving and piping means, wherein said inlet piping means is comprised of a box-shaped header pipe extending in front of each of said upper and lower inlet side tubes, said header having a central inlet for introducing said gas stream into said apparatus, an upper inlet connection above said inlet for connecting said box-shaped header to said upper tube end, and a lower inlet connection below said inlet for connecting said box-shaped header to said lower tube end, each of said upper and lower inlet connections having a boxed configuration, said outlet side of said upper and lower tubes having tube ends in communication with each other through said outlet valving and piping means, wherein said outlet piping means is comprised of a box-shaped outlet header pipe extending in front of each of said upper and lower outlet side tubes, said header having a central outlet for removing said process gas stream from said apparatus, an upper outlet pipe connection above said outlet for connecting said outlet to said upper tube end, and a lower outlet pipe connection for connecting said outlet to said lower tube end, said inlet valving means comprised of an upper and a lower valve respectively received within each of said inlet side upper and lower tube ends, and operable in an axial direction between an inner, open position and an outer, closed position, each of said valves having a valve body corresponding to an internal cross-section of said respective tube, each of said upper and lower valves respectively capable of preventing said communication between said upper tube and said upper connection and said lower tube and said lower connection when said respective valve is in said closed position, said outlet valving means comprised of an upper and a lower valve respectively received within each of said outlet side upper and lower tube ends, and operable in an axial direction between an inner, open position and an outer, closed position, each of said valves having a valve body corresponding to an internal cross-section of said respective tube, each of said upper and lower valves respectively capable of preventing communication between said upper tube and said lower connection and said lower tube and said lower connection when said respective valve is in said closed position, wherein in a first mode of operation, each of said upper inlet valves are in said closed position and each of said lower inlet valves are in said open position, while each of said upper outlet valves are in said open position and each of said lower outlet valves are in said closed position, said process gas stream entering each of said lower tubes and forced to exit said tubes through said perforations therein, said process gas steam upwardly percolating through said stationary bed and forced into said perforations in each of said upper tubes, wherein said gas stream exits each of said upper tubes and said apparatus through said outlet as a contaminant-free gas stream, and wherein in a second mode of operation, each of said upper inlet valves are in said open position and each of said lower inlet valves are in said closed position, while each of said upper outlet valves are in said closed position and each of said lower outlet valves are in said open position, said process gas stream entering each of said upper tubes and forced to exit each of said tubes through said perforations therein, said process gas stream downwardly percolating through said stationary bed and forced into said perforations in each of said lower tubes, wherein said gas stream exits each of said lower tubes and said apparatus through said outlet as a contaminant-free gas stream.

5. A combustion device as claimed in claim 4, wherein the separated sections are positioned in the apparatus in a superposed relationship said separated sections further by a horizontal partition wall.

6. The apparatus of claim 4, wherein a first apparatus is positioned in superposed relationship over a second apparatus, the upper horizontal tubes in said first apparatus and the lower horizontal tubes second apparatus are combined into a common tube, and respectively supplied simultaneously with said gas with no separating horizontal partition wall being provided, whereby a double section is created.

7. The apparatus as claimed in claim 4, wherein each valve means further comprises a valve actuator which is actuated by a pressure medium, said valve body being attached to a piston rod of said actuator in a manner that the actuator displaces said valve body in the axial direction of the tube.

8. The apparatus of claim 4, wherein a change in the mode of operation from said first mode to said second mode is made through a re-setting of the valves such that there is a delay in the various pairs of valves in the first mode to that of the second mode in order to attenuate pressure peaks during said change.

* * * * *